US009951797B2

(12) United States Patent
Imura et al.

(10) Patent No.: US 9,951,797 B2
(45) Date of Patent: Apr. 24, 2018

(54) WORK MACHINE

(71) Applicants: Hitachi Construction Machinery Co., Ltd., Bunkyo-ku, Tokyo (JP); Takako Satake, Tsuchiura (JP)

(72) Inventors: Shinya Imura, Tokyo (JP); Kouji Ishikawa, Tsuchiura (JP); Hidetoshi Satake, Ishioka (JP); Tomoaki Kaneta, Tsuchiura-shi, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 390 days.

(21) Appl. No.: 14/436,395

(22) PCT Filed: Oct. 17, 2013

(86) PCT No.: PCT/JP2013/078202

§ 371 (c)(1),
(2) Date: Apr. 16, 2015

(87) PCT Pub. No.: WO2014/061741

PCT Pub. Date: Apr. 24, 2014

(65) Prior Publication Data

US 2015/0252819 A1 Sep. 10, 2015

(30) Foreign Application Priority Data

Oct. 18, 2012 (JP) ..... 2012-231101

(51) Int. Cl.
*F15B 11/042* (2006.01)
*E02F 9/22* (2006.01)
(Continued)

(52) U.S. Cl.
CPC ..... *F15B 11/0423* (2013.01); *E02F 9/2225* (2013.01); *E02F 9/2235* (2013.01);
(Continued)

(58) Field of Classification Search
CPC ..... E02F 9/2225; E02F 9/2235; E02F 9/2285; E02F 9/2292; E02F 9/2296; F15B 11/0423; F15B 11/08; F15B 13/02
See application file for complete search history.

(56) References Cited

U.S. PATENT DOCUMENTS 5,758,499 A * 6/1998 Sugiyama ..... F04B 49/065 60/450
6,378,303 B1 * 4/2002 Higuchi ..... E02F 9/2235 60/468
(Continued)

FOREIGN PATENT DOCUMENTS

JP 11-256623 A 9/1999
JP 2000-35005 A 2/2000
(Continued)

OTHER PUBLICATIONS

Korean Office Action issued in counterpart Korean Application No. 10-2015-7009156 dated Sep. 23, 2016 (five (5) pages).
(Continued)

*Primary Examiner* — Michael Leslie
*Assistant Examiner* — Richard Drake
(74) *Attorney, Agent, or Firm* — Crowell & Moring LLP

(57) ABSTRACT

Provided is a work machine including: a variable-displacement pump 2; an actuator 5 driven by a hydraulic fluid delivered from the pump 2; a flow control valve 4 of an open-center type that controls a flow rate of the hydraulic fluid supplied to the actuator 5; a bleed-off line 8*a* connecting the actuator flow control valve 4 to a tank 6; a bleed-off flow control valve 8 disposed in the bleed-off line 8*a*; an operating device 3 that specifies operation of the actuator 5; a bleed-off control device 14 that controls a degree of opening of the bleed-off flow control valve 8 in accordance with an amount of manipulation of the operating device 3; and a pump control device 15 that controls, in accordance
(Continued)

with the degree of opening of the bleed-off flow control valve 8, a pump flow rate by correcting a reference pump flow rate that is based on the amount of manipulation of the operating device 3. The work machine with this configuration can save energy while at the same time inhibiting an occurrence of a sense of strangeness or discomfort in particular operation.

5 Claims, 9 Drawing Sheets

(51) Int. Cl.

| | |
|---|---|
| ***E02F 9/24*** | (2006.01) |
| ***F04B 49/22*** | (2006.01) |
| ***E02F 9/26*** | (2006.01) |
| ***F15B 11/08*** | (2006.01) |
| ***F15B 13/02*** | (2006.01) |

(52) U.S. Cl.

CPC ..... *E02F 9/2285* (2013.01); *E02F 9/2292* (2013.01); *E02F 9/2296* (2013.01); *E02F 9/24* (2013.01); *E02F 9/268* (2013.01); *F04B 49/22* (2013.01); *F15B 11/08* (2013.01); *F15B 13/02* (2013.01); *F15B 2211/20546* (2013.01); *F15B 2211/3116* (2013.01); *F15B 2211/40515* (2013.01); *F15B 2211/41581* (2013.01); *F15B 2211/45* (2013.01); *F15B 2211/6346* (2013.01); *F15B 2211/665* (2013.01); *F15B 2211/6652* (2013.01); *F15B 2211/6658* (2013.01)

(56) References Cited

U.S. PATENT DOCUMENTS

| | | | | |
|---|---|---|---|---|
| 8,700,275 | B2 * | 4/2014 | Edamura | E02F 9/123 701/29.1 |
| 8,959,918 | B2 * | 2/2015 | Nishikawa | E02F 9/123 180/65.21 |
| 9,290,908 | B2 * | 3/2016 | Hiroki | E02F 9/123 |
| 2002/0014075 | A1 | 2/2002 | Sawada et al. | |
| 2002/0131913 | A1 | 9/2002 | Tamata et al. | |
| 2006/0142107 | A1 | 6/2006 | Kobayashi et al. | |
| 2012/0198831 | A1 * | 8/2012 | Kodaka | E02F 3/962 60/422 |

FOREIGN PATENT DOCUMENTS

| | | | | |
|---|---|---|---|---|
| JP | 2006-207800 | A | 8/2006 | |
| JP | 2011-85198 | A | 4/2011 | |
| JP | 2011-94687 | A | 5/2011 | |
| JP | 2012-137149 | A | 7/2012 | |
| JP | WO 2012128132 | A1 * | 9/2012 | E02F 9/123 |
| KR | 2002-0001516 | | 1/2002 | |
| KR | 2012-0115281 | | 10/2012 | |

OTHER PUBLICATIONS

International Preliminary Report on Patentability (PCT/IB/338 & PCT/IB/373), including English-language translation of Written Opinion (PCT/ISA/237) dated Apr. 30, 2015 (six (6) pages).

International Search Report (PCT/ISA/210) dated Jan. 21, 2014, with English translation (Five (5) pages).

Japanese language Written Opinion (PCT/ISA/237) dated Jan. 21, 2014 (Three (3) pages).

* cited by examiner

WORK MACHINE

TECHNICAL FIELD

The present invention relates to hydraulic excavators and other work machines equipped with hydraulic actuators.

BACKGROUND ART

Work machines such as hydraulic excavators generally control operation of actuators by driving a pump using an engine and by controlling flow rates and directions of a hydraulic fluid supplied from the pump to the actuators. One of devices that control the flow of a hydraulic fluid into an actuator is a flow control valve of an open-center type. When this type of flow control valve is used, under a state where the hydraulic fluid is not supplied to the actuator, the fluid flows into a tank via a bleed-off opening in the valve. When the hydraulic fluid is supplied to the actuator, on the other hand, a meter-in opening in the flow control valve, connecting to the actuator, increases in area and the bleed-off opening correspondingly decreases in area (refer to Patent Document 1).

PRIOR ART DOCUMENTS

Patent Documents

Patent Document 1: JP-2011-85198-A

SUMMARY OF THE INVENTION

Problems to be Solved by the Invention

To supply a hydraulic fluid to a heavily loaded actuator, the hydraulic fluid needs to be supplied at a pressure higher than the load pressure applied to the actuator. An operator might be forced to manipulate a lever through a stroke larger than that usually needed. If this is the case, pump flow will increase in accordance with the particular manipulation stroke of the lever, which will in turn raise a flow rate of the hydraulic fluid passed through the bleed-off opening in the open-center type of flow control valve, thus cause an excessive flow of the hydraulic fluid which returns to the tank without contributing to operation of the actuator, and lead to a significant loss of energy.

By contrast, the construction machine described in Patent Document 1 includes a cutoff valve that cuts off the flow of a hydraulic fluid from a bleed-off line to a tank. When the hydraulic fluid is supplied to a heavily loaded actuator, the cutoff valve closes. Even if a lever is not manipulated through a stroke larger than that usually needed, the hydraulic fluid is supplied to the actuator at a pressure higher than a load pressure.

In light of operationality of work machines, however, cutting off the flow of the hydraulic fluid within the bleed-off line may not be preferable, even for a heavy-load job. For example, when a swing structure is swung with respect to a track structure, if the fluid line to the tank is cut off, all the fluid delivered from the pump will attempt to flow into a swing motor. However, since the swing structure has high inertia, a long time will be required for the swing motor to increase its rotating speed. At least until the swing motor speed has increased to a level based on the pump flow, the flow of the hydraulic fluid into the swing motor is likely to be continuously limited and the pump will increase its fluid delivery pressure to a level higher than that usually needed.

Even if the lever is manipulated through a small stroke, this increase may cause the higher fluid delivery pressure of the pump and raise the acceleration of the swing operation despite the small manipulation stroke of the lever to end up being accompanied by a sense of strangeness or discomfort in the operation of the lever.

The present invention has been made on the basis of the above problems, and an object of the invention is to provide a work machine adapted to save energy while at the same time inhibiting an occurrence of a sense of strangeness or discomfort in particular operation.

Means for Solving the Problems

An aspect of the present invention contemplated to achieve the above object includes: a variable-displacement pump; an actuator driven by a hydraulic fluid delivered from the pump; a flow control valve of an open-center type that controls a flow rate of the hydraulic fluid supplied to the actuator; a bleed-off line connecting the actuator flow control valve to a tank; a bleed-off flow control valve disposed in the bleed-off line; an operating device that specifies operation of the actuator; a bleed-off control device that controls a degree of opening of the bleed-off flow control valve in accordance with an amount of manipulation of the operating device; and a pump control device that controls, in accordance with the degree of opening of the bleed-off flow control valve, a pump flow rate by correcting a reference pump flow rate that is based on the amount of manipulation of the operating device.

Advantageous Effect of the Invention

A work machine adapted to save energy while at the same time inhibiting the occurrence of a sense of strangeness or discomfort in particular operation can be realized in accordance with the present invention.

MODES FOR CARRYING OUT THE INVENTION

Embodiments of the present invention will be described hereunder with reference to the accompanying drawings.

While examples of applying the present invention to a hydraulic excavator will be taken in the following embodiments, the invention is not limited to the hydraulic excavator and can also be applied to a full range of work machines equipped with hydraulic actuators.

First Embodiment

Work Machine

Figure 1:
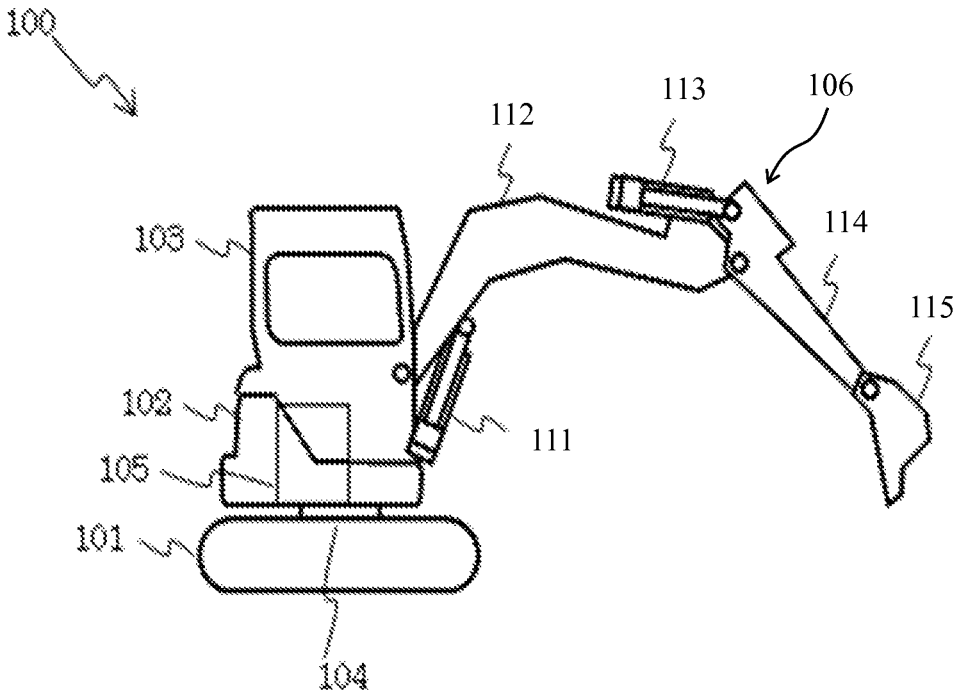
FIG. 1 is a side view of a work machine according to the present invention.

FIG. 1 is a side view of a work machine according to a first embodiment of the present invention.

The work machine, shown as a hydraulic excavator 100 in FIG. 1, includes a track structure 101 equipped with left and right track devices of a crawler type, and a swing structure 102 with a cab 103. In this specification, a direction in which an operator faces when onboard in the cab 103 is forward (in FIG. 1, rightward). The left and right track devices each include an independent track motor, and forward traveling, reversing, turning, and other traveling operations of the vehicle are performed when the left and right track motors are driven as appropriate. The swing structure 102 is swingably coupled to an upper section of the track structure 101 via a swing device 104. The swing device 104 includes a swing motor (not shown), and driving of the swing motor swings the swing structure 102.

On a front section of the swing structure 102 is disposed an end section of a work tool (front work tool) 106, which includes a boom 112, an arm 114, and a bucket 115. The boom 112 is coupled to the swing structure 102 so as to be vertically inclinable with respect thereto, and is driven by a boom cylinder 111. The boom cylinder 111 is coupled at a distal end of its rod to the boom 112, and at a proximal end of its cylinder tube to the swing structure 102. The arm 114 is coupled to a distal end of the boom 112 so as to be able to sway back and forth, and is driven by an arm cylinder 113. The arm cylinder 113 is coupled at a distal end of its rod to the arm 114, and at a proximal end of its cylinder tube to the boom 112. The bucket 115 is coupled to a distal end of the arm 114 so as to be able to sway back and forth, and is driven by a bucket cylinder (not shown). The bucket cylinder is coupled at a distal end of its rod to the bucket 115, and at a proximal end of its cylinder tube to the arm 114.

The swing structure 102 includes a hydraulic drive system 105 that drives hydraulic actuators, such as the boom cylinder 111, arm cylinder 113, bucket cylinder, swing motor, and track motors, that are mounted on the hydraulic excavator 100. These actuators are driven by the closed-circuit hydraulic drive system 105 in accordance with operation of operating devices placed in the cab 103, such as a lever control device 3 (see FIG. 2) and pedals. An operating direction and operating speed of each hydraulic actuator are specified by a manipulating direction and actual manipulation stroke (amount of manipulation) of a relevant operating device.

Hydraulic Drive System

Figure 2:
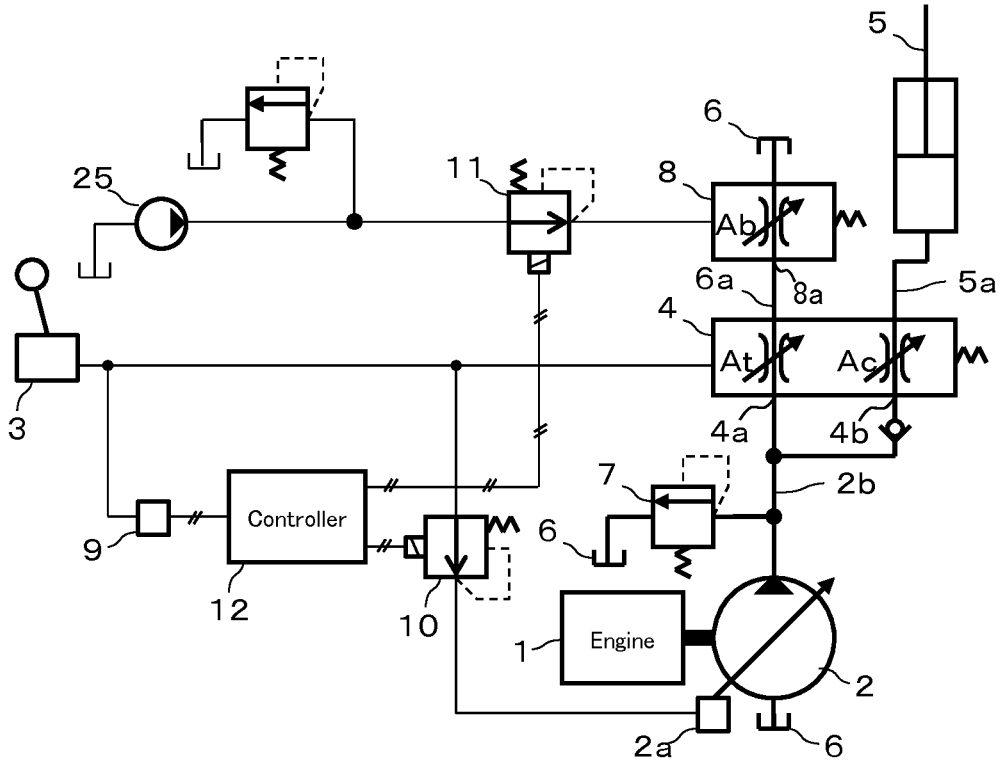
FIG. 2 is a circuit diagram that represents chief elements of a hydraulic drive system in a selectively extracted form, the system being provided on the work machine according to the first embodiment of the present invention.

FIG. 2 is a circuit diagram that represents chief elements of the hydraulic drive system in a selectively extracted form, the system being provided on the work machine according to the first embodiment of the present invention. While circuit elements that drive one of the hydraulic actuators are shown in a selectively extracted form in the figure, other circuit elements that drive the other hydraulic actuators may also be substantially of the same composition as that shown in the figure.

The hydraulic drive system shown in FIG. 2 includes: an engine 1 serving as a motive power source; a hydraulic pump 2; the lever control device 3; an actuator flow control valve 4; the hydraulic actuator 5 driven by a hydraulic fluid of the hydraulic pump 2; a hydraulic fluid tank 6; a relief valve 7 that limits a pressure of the hydraulic circuit; a bleed-off flow control valve 8 that controls a bleed-off flow rate by changing an opening area; a pressure sensor 9 that outputs an electrical signal based on an operating pilot pressure generated by the lever control device 3; a pump control pressure generator 10; a bleed-off control pressure generator 11 that generates a bleed-off control pressure for driving the bleed-off flow control valve 8; and a controller 12 that sends control command values to the pump control pressure generator 10 and the bleed-off control pressure generator 11.

The hydraulic pump 2 is of a variable-displacement type driven by the engine 1, and includes, for example, a bent axis as a variable-displacement mechanism. In this case, the hydraulic pump 2 changes a capacity (displacement volume) by controlling the tilt angle of the bent axis using a capacity control system 2*a* to thereby change a delivery rate of the hydraulic fluid (i.e., the pump flow rate). The capacity control system 2*a* is driven by a pump control pressure that the pump control pressure generator 10 generates.

The lever control device 3, provided for the operator to specify operation of an actuator (here, the hydraulic actuator 5), has a pressure reducer function for reducing a hydraulic pressure in accordance with a particular amount of manipulation of the lever, the hydraulic pressure being a pressure that has been generated by a hydraulic pressure source, a pilot pump (not shown).

The actuator flow control valve 4 is a flow control valve of an open-center type that controls a flow rate (direction included) of the hydraulic fluid supplied to the hydraulic actuator 5, and the control valve includes a spool actuated by the operating pilot pressure. The spool includes a meter-in opening 4*b*, a bleed-off opening 4*a*, and a meter-out line (not shown). The meter-in opening 4*b* causes a fluid delivery line 2*b* of the hydraulic pump 2 to communicate with the meter-in line 5*a* through which the hydraulic fluid is supplied to the hydraulic actuator 5. An area of this opening is referred to as the meter-in opening area Ac. The bleed-off opening 4*a* causes the fluid delivery line 2*b* to communicate with a bleed-off line 6*a* connecting to the tank 6. An area of this opening is referred to as the bleed-off opening area At. The meter-out opening (not shown) causes the tank 6 to communicate with the meter-out line (not shown) through which the hydraulic fluid delivered from the hydraulic actuator 5 flows. An area of this opening is referred to as the meter-out opening area. Movements of the spool change a rate between the meter-in opening area Ac, the bleed-off opening area At, and the meter-out opening area.

The hydraulic actuator 5 is one of the hydraulic actuators such as the boom cylinder 11, arm cylinder 113, bucket cylinder, swing motor, and track motors. FIG. 2 shows a hydraulic cylinder as an example of the hydraulic actuator 5. The hydraulic actuator 5 operates at a speed proportional to a meter-in flow rate at which the hydraulic fluid flows into the meter-in line 5*a*.

The relief valve 7, intended to protect the hydraulic line through which the hydraulic fluid flows, is connected to the fluid delivery line 2*b* of the hydraulic pump 2 and constructed so that when an internal pressure of the fluid delivery line 2*b* increases above a preset pressure, the relief valve 7 opens to vent the hydraulic fluid from the fluid delivery line 2*b* into the tank 6.

The bleed-off flow control valve 8 is disposed in the bleed-off line 6*a*, that is, between the actuator flow control valve 4 and the tank 6. The bleed-off flow control valve 8 includes a bleed-off opening 8*a* in its spool, and movements of the spool vary a bleed-off opening area Ab, an opening area of the bleed-off opening 8*a*. The spool is actuated by the bleed-off control pressure that the bleed-off control pressure generator 11 has generated. The pump flow rate Qp is distributed to the meter-in flow rate Qc and the bleed-off flow rate Qt, depending on the bleed-off opening area Ab of the bleed-off flow control valve 8 and the meter-in opening area Ac and bleed-off opening area At of the actuator flow control valve 4. Defining the fluid delivery pressure of the hydraulic pump 2 as Pp, a meter-in pressure of the hydraulic actuator 5 as Pc, and an internal pressure of the tank 6 as Pt allows us to express the above three flow rates as follows:

$$Qp=Qc+Qt \quad \text{(Formula 1)}$$

$$Qc=c\cdot Ac\cdot(Pp-Pc)^{1/2} \quad \text{(Formula 2)}$$

$$Qt=c\cdot At'\cdot(Pp-Pt)^{1/2} \quad \text{(Formula 3)}$$

where 'c' is a coefficient, which, if a flow coefficient is taken as Cd and a density of the fluid as ρ, is represented by the following formula:

$$c=Cd\times(2/\rho)^{1/2} \quad \text{(Formula 4)}$$

where At', which denotes a combined opening area of At and Ab, is expressed as follows:

$$At'=(At\cdot Ab)/(At^2+Ab^2)^{1/2} \quad \text{(Formula 5)}$$

The pump control pressure generator 10 is a solenoid-operated pressure-reducing valve, configured to reduce the operating pilot pressure according to a command sent from the controller 12 and generate the pump control pressure supplied to the capacity control system 2*a*.

The bleed-off control pressure generator 11, which is also a solenoid-operated pressure-reducing valve, is configured to reduce a pilot pressure according to another command sent from the controller 12 and generate a bleed-off control pressure, the pilot pressure being a pressure that has been generated by the pilot pump 25, the hydraulic pressure source.

Controller

Figure 3:
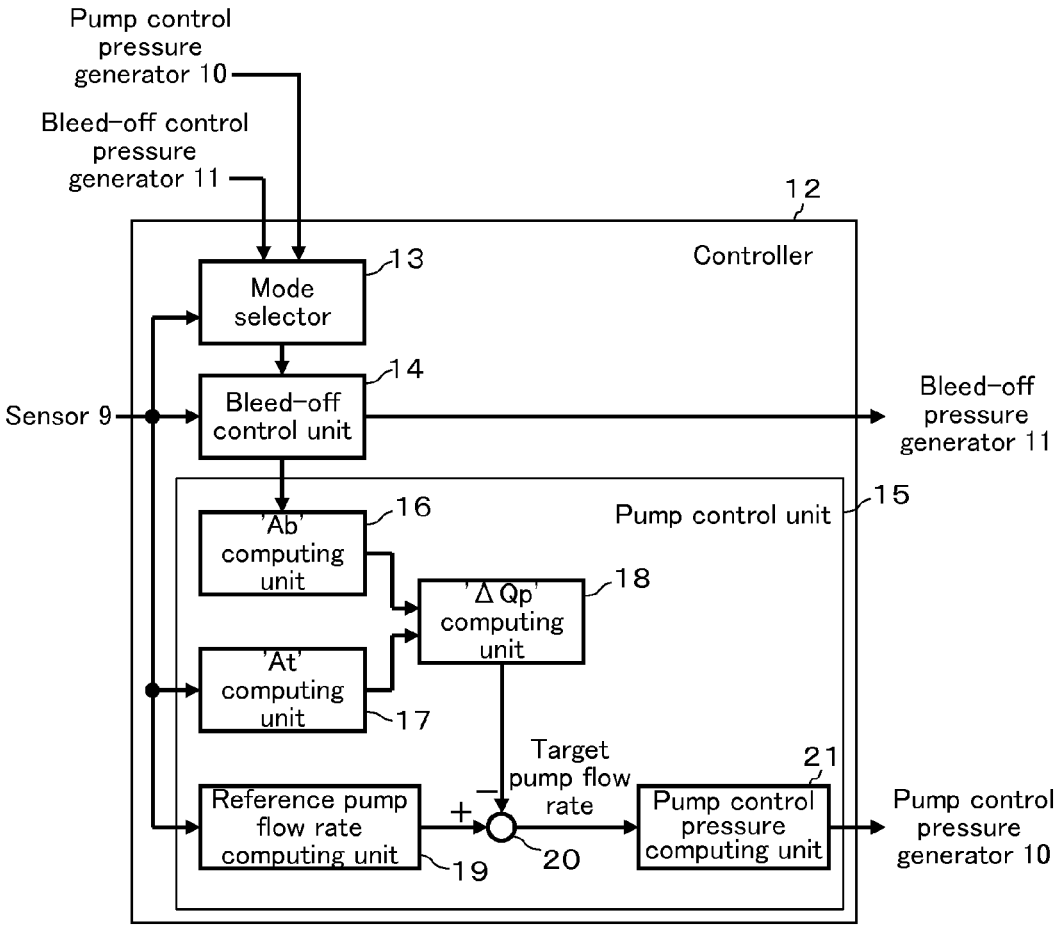
FIG. 3 is a function block diagram of a controller provided on the work machine according to the first embodiment of the present invention.
Figure 4A:
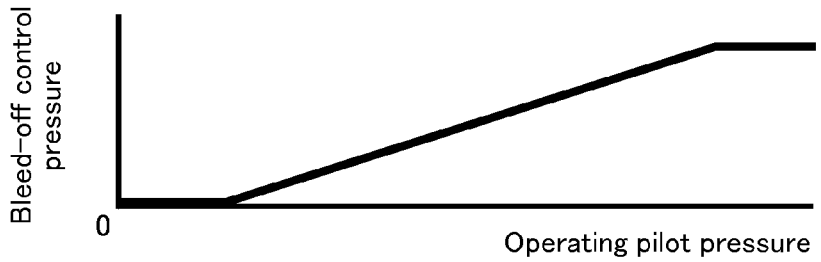
FIG. 4A-4E are diagrams that represent behavior patterns of various values with respect to the amount of manipulation of an operating device.
Figure 4B:
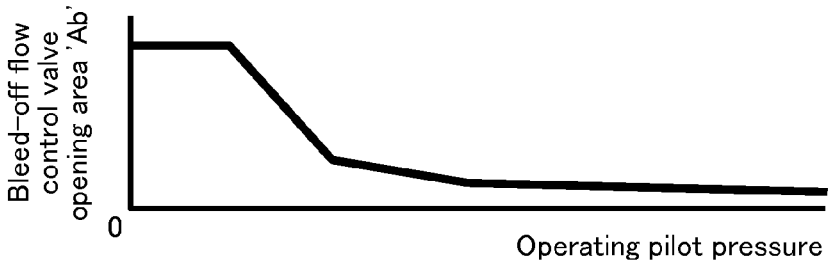
Figure 4C:
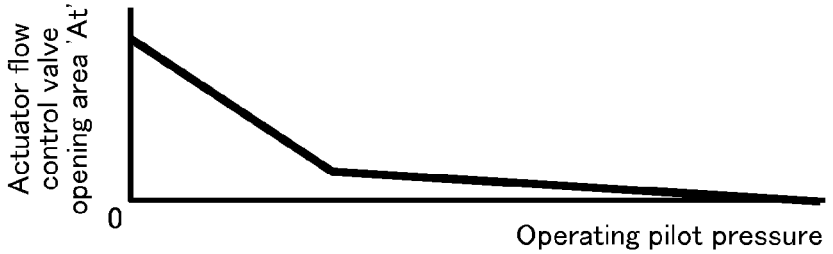
Figure 4D:
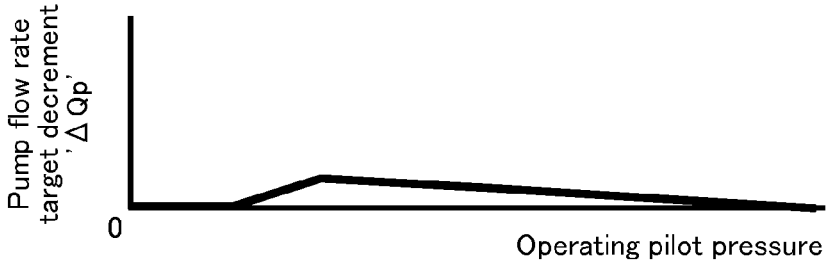
Figure 4E:
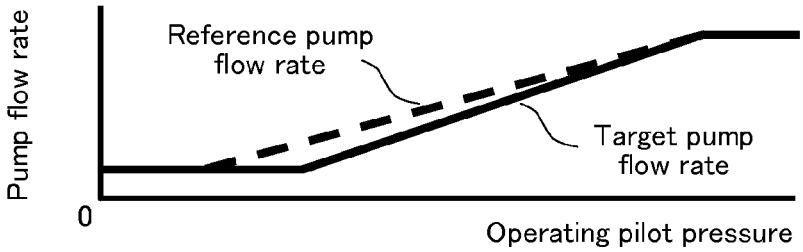
Figure 5A:
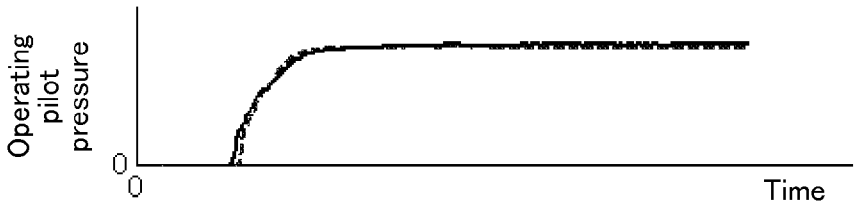
FIG. 5A-5F are diagrams that represent time-varying behavior patterns of other various values associated with the manipulation of the operating device.
Figure 5B:
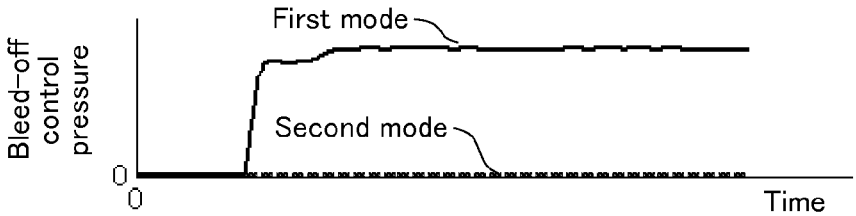
Figure 5C:
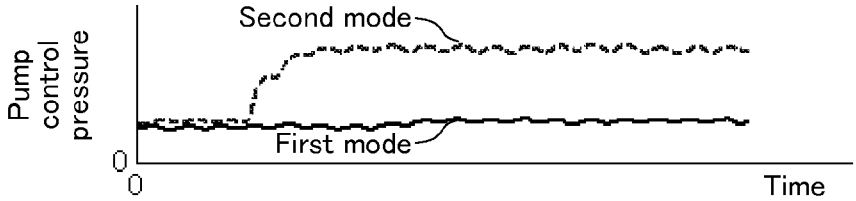
Figure 5D:
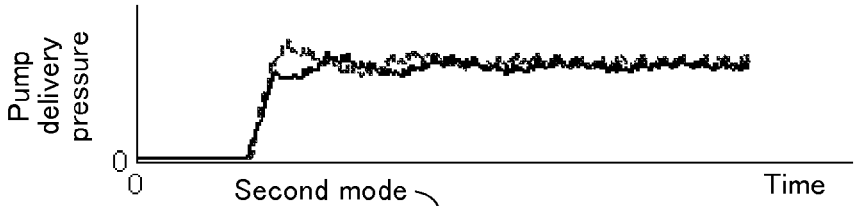
Figure 5E:
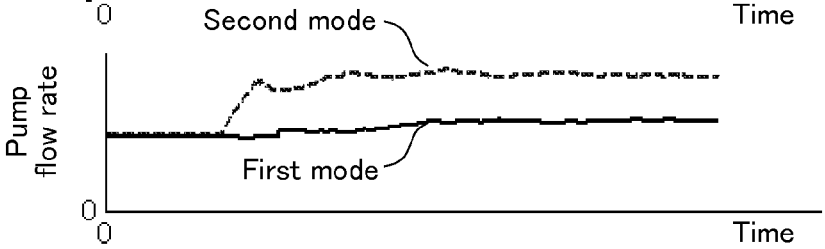
Figure 5F:
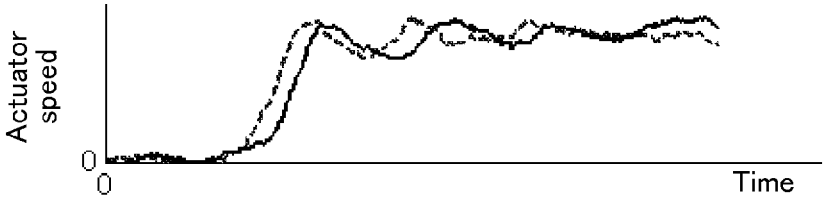

FIG. 3 is a function block diagram of the controller.

As shown in FIG. 3, the controller 12 includes a mode selector 13, a bleed-off control unit 14, and a pump control unit 15.

The mode selector 13 is a function block that selects a first mode or a second mode and then specifies the selected mode to the bleed-off control unit 14. The first mode controls the degree of opening of the bleed-off flow control valve 8 in accordance with the particular amount of manipulation of the lever control device 3. The second mode keeps the degree of opening of the bleed-off flow control valve 8 constant (in the present embodiment, a maximum degree of opening), independently of the amount of manipulation of the lever control device 3. The mode selector 13 allows the first mode to be selected when control operation of both the hydraulic pump 2 and the bleed-off flow control valve 8 is normal, and the second mode to be selected when the control operation of at least one of the hydraulic pump 2 and the bleed-off flow control valve 8 is abnormal. The mode selector 13 then outputs either selection result to the bleed-off control unit 14.

The normal control operation here refers to a state in which an abnormality of a device relating to the control or operation of the hydraulic pump 2 and the bleed-off flow control valve 8 cannot be recognized. Whether the control operation is normal can be determined, for example, from a signal level of either the pressure sensor 9, the pump control pressure generator 10, or the bleed-off control pressure generator 11. For the pressure sensor 9, it can be determined that if a detection signal from the sensor is not in an appropriate range (a detection range) or if an electrical line of the sensor is disconnected, the sensor itself is not properly functioning. For the pump control pressure generator 10 or the bleed-off control pressure generator 11, it can be determined whether the control pressure is being controlled exactly as specified by a command value of the controller 12. For the pump control pressure generator 10 or the bleed-off control pressure generator 11, as long as the present invention is configured so that a value denoting an electric current that flows through the solenoid-operated pressure-reducing valve in accordance with the command value from the controller 12 is input to the mode selector 13, the generator can be determined not to be functioning properly if an error between the input current and a value based on the command value from the controller 12 oversteps an allowable range or exceeds a preset value.

The bleed-off control unit 14 can selectively execute the first mode or the second mode, depending on an input signal from the mode selector 13. In the first mode, the control unit 14 determines a command value of the bleed-off control pressure according to the operating pilot pressure (signal from the pressure sensor 9) corresponding to the amount of manipulation of the lever control device 3, then outputs the command value to the bleed-off control pressure generator 11, and controls the degree of opening of the bleed-off flow control valve 8 (i.e., the bleed-off opening area Ab). The command value of the bleed-off control pressure is determined so that for example, as shown in FIG. 4(*b*), when the operating pilot pressure is 0 (zero) or close thereto, the bleed-off opening area Ab is maximized and as the operating pilot pressure increases, Ab is reduced. In this case, such a table as that shown by way of example in FIG. 4(*a*) to represent a relationship between the operating pilot pressure and the bleed-off control pressure is stored into the bleed-off control unit 14 beforehand and the command value of the bleed-off control pressure that corresponds to the operating pilot pressure which has been input from the pressure sensor 9 is determined in keeping with the table. In the second mode, by contrast, the degree of opening of the bleed-off flow control valve 8 is kept constant (in the present embodiment, the maximum degree of opening), independently of the amount of manipulation of the lever control device 3. In the second mode of the present embodiment, the bleed-off control pressure is not generated by the bleed-off control pressure generator 11. The degree of opening of the bleed-off flow control valve 8 is maximized when the bleed-off control pressure is not generated.

The pump control unit 15 includes an 'Ab' computing unit 16 that computes the bleed-off opening area Ab of the bleed-off flow control valve 8, an 'At' computing unit 17 that computes the bleed-off opening area At of the actuator flow control valve 4, a 'ΔQ' computing unit 18 that computes a bleed-off flow rate target decrement ΔQ, a reference pump flow rate computing unit 19 that computes a reference pump flow rate, a differential computing unit 20 that computes a difference between the reference pump flow rate and ΔQ, and a pump control pressure computing unit 21 that computes a command value of the pump control pressure and outputs the computed command value to the pump control pressure generator 10. The pump control unit 15 activates the computing units 16 through 21 to control the fluid delivery rate of the hydraulic pump 2 according to a particular control value of the bleed-off control unit 14 (i.e., the command value of the bleed-off control pressure) and the amount of manipulation of the lever control device 3 (i.e., the operating pilot pressure). More specifically, the pump control unit 15 computes the pump control pressure to ensure that the pump flow rate Qp decreases by a decrement in bleed-off flow rate Qt resulting from a decrease in the opening area Ab of the bleed-off flow control valve 8.

The 'Ab' computing unit 16 estimates the opening area Ab of the bleed-off flow control valve 8 on the basis of the command value of the bleed-off control pressure that has been computed by the bleed-off control unit 14. Such a table as that shown by way of example in FIG. 4(*b*) to represent a relationship between the bleed-off control pressure and the bleed-off opening area Ab is stored into the 'Ab' computing unit 16 beforehand and the bleed-off opening area Ab corresponding to the command value of the bleed-off control pressure that has been input from the bleed-off control unit 14 is determined in keeping with the table.

The 'At' computing unit 17 estimates the bleed-off opening area At of the actuator flow control valve 4 from the operating pilot pressure. Such a table as that shown by way of example in FIG. 4(*c*) to represent a relationship of the bleed-off opening area At with respect to the operating pilot pressure is stored into the 'At' computing unit 17 beforehand and the bleed-off opening area At corresponding to the operating pilot pressure that was input from the pressure sensor 9 is determined in keeping with the table.

The 'ΔQ' computing unit 18 computes the decrement in bleed-off flow Qt (i.e., a difference between the as-maximized bleed-off opening area Ab and Qt) due to the decrease in bleed-off opening area Ab (i.e., a difference between Ab and its maximum value), and outputs the computed value as a target decrement ΔQp in pump flow rate Qp. For example, ΔQp is calculated with the following formula:

$$\Delta Qp = c \cdot \Delta At' \cdot (Pp - Pt)^{1/2} \quad \text{(Formula 6)}$$

where ΔAt' is a decrement in the combined opening area of At and Ab. If the maximum value of the opening area Ab is defined as Abmax, ΔAt' can be represented with the following formula:

$$\Delta At' = (At' \cdot Ab\max)/(At^2 + A\max^2)^{1/2} - (At \cdot Ab)/(At^2 + Ab^2)^{1/2} \quad \text{(Formula 7)}$$

In the second mode, ΔQ=0 because Ab is maximized.

For example, the 'ΔQ' computing unit 18 sets average values of the pump fluid delivery pressure Pp and the tank pressure Pt in advance and assigns the average values to formula 6 to find ΔQp. Alternatively, sensors that detect the pump fluid delivery pressure Pp and the tank pressure Pt may be provided and values that these sensors have detected may be assigned to formula 6 to find ΔQp. In addition, if a table shown by way of example in FIG. 4(*d*) to represent a relationship between the operating pilot pressure and the pump flow rate target decrement ΔQp that was computed using formula 6 is stored into the 'ΔQ' computing unit 18 beforehand, ΔQp corresponding to the operating pilot pressure that was input from the pressure sensor 9 is determined in keeping with the table.

On the basis of the operating pilot pressure, the reference pump flow rate computing unit 19 computes the pump flow rate in the second mode (i.e., when the degree of opening of the bleed-off flow control valve 8 is maximized) and outputs the computed value as the reference pump flow rate. For example, a table representing a relationship of the operating pilot pressure with respect to the reference pump flow rate can be stored into the reference pump flow rate computing unit 19 beforehand and the reference pump flow rate corresponding to the operating pilot pressure that was input from the pressure sensor 9 is determined in keeping with the table. In addition, the reference pump flow rate can likewise be computed by computing from a previously created table a reference pump volume in a manner similar to the above, and multiplying the reference pump volume by a rotating speed of the pump.

The differential computing unit 20 subtracts the pump flow rate target decrement ΔQp from the reference pump flow rate that the reference pump flow computing unit 19 has computed, and computes a target pump flow rate. A relationship between the thus-computed reference pump flow rate and target pump flow rate and the operating pilot pressure is shown in FIG. 4(*e*) by way of example.

The pump control pressure computing unit 21 computes the command value of the pump control pressure so that an actual pump flow rate approaches the target pump flow rate, and outputs the computed value to the pump control pressure generator 10. In the second mode, since ΔQ=0, the computing result by the differential computing unit 20 is equal to the reference pump flow rate. Consequently, in the pump control unit 15, in the first mode the operating pilot pressure is reduced in accordance with the particular degree of opening of the bleed-off flow control valve 8 and is then output to the pump control pressure generator 10, whereas in the second mode the operating pilot pressure is output to the pump control pressure generator 10 without being reduced.

Operation and Advantages

Once the operator manipulates the lever control device 3, the appropriate operating pilot pressure is generated in accordance with the particular amount of manipulation. The capacity of the hydraulic pump 2 and the spool position of the actuator flow control valve 4 vary with the pressure consequently. A larger amount of manipulation increases the capacity of the hydraulic pump 2 more as well as the pump flow rate. A larger amount of manipulation increases the meter-in opening area Ac of the actuator flow control valve 4 more and correspondingly reduces the bleed-off opening area At. Hence, as the lever is manipulated through a larger stroke, a greater amount of hydraulic fluid flows into the hydraulic actuator and the actuator operates at a higher speed.

At this time, as described earlier herein, in the first mode the controller 12 controls the degree of opening of the bleed-off flow control valve 8 in accordance with the amount of manipulation of the lever control device 3. Additionally, the controller 12 corrects, in accordance with the degree of opening of the bleed-off flow control valve 8, a target flow rate based on the amount of manipulation (i.e., the reference pump flow rate; in other words, the target pump flow rate in the second mode), and outputs the pump control pressure. In the present embodiment, the pump flow rate is controlled in accordance with the amount of manipulation of the lever control device 3 and the degree of opening of the bleed-off flow control valve 8, and the pump flow rate based on the amount of manipulation of the lever control device 3 is reduced in accordance with the degree of opening of the bleed-off flow control valve 8. In the second mode, on the other hand, the controller 12 does not control the bleed-off flow control valve 8 (in the present embodiment, the degree of opening is maximized) and the pump control pressure is generated in response only to the operating pilot pressure and directly output.

FIG. 5 is a diagram that represents time-varying behavior patterns of other various values associated to the manipulation of the lever control device 3. The solid lines in the figure denote the behavior patterns in the first mode, and dotted lines denote the behavior patterns in the second mode.

FIG. 5(*a*) shows a behavior pattern of the operating pilot pressure by way of example. The solid line and dotted line in the figure nearly overlap each other, which indicates that the operation in the first mode is the same as those of the second mode.

FIG. 5(*b*) shows the bleed-off control pressure that was input to the bleed-off flow control valve 8. It can be seen from this figure that in the first mode, as the operating pilot pressure rises, the bleed-off control pressure also increases. The degree of opening of the bleed-off flow control valve 8 is controlled to decrease along with the greater amount of manipulation. It can also be seen that in the second mode, the bleed-off control pressure is not generated even if the operating pilot pressure increases, and the degree of opening of the bleed-off flow control valve 8 is controlled to remain maximized.

FIG. 5(*c*) shows the pump control pressure that was input to the capacity control system 2*a* of the hydraulic pump 2. It can be seen from this figure that in the second mode, the pump control pressure increases in accordance with the amount of manipulation, while the pump flow rate is controlled to increase in accordance with the amount of manipulation. At the same time, it can also be seen that in the first mode, the pump control pressure is controlled to a low level with respect to the pump flow rate based on the amount of manipulation. The result is that as shown in FIG. 5(*e*), even if the amount of manipulation is the same between the first mode and the second mode, in the first mode the pump flow rate is controlled to a lower level than in the second mode. As the degree of opening of the bleed-off flow control valve 8 becomes smaller, the pump flow rate decreases with respect to the reference pump flow rate (deviations from the reference pump flow rate become larger).

In the first mode, the pump flow rate is lower than in the second mode. However, since the degree of opening of the bleed-off flow control valve 8 is correspondingly small, the fluid delivery pressure of the pump is controlled to be substantially at the same level between the first mode and the second mode, as shown in FIG. 5(*d*).

A value obtained by multiplying the fluid delivery pressure of the pump by the pump flow rate is proportional to the engine load. In the first mode, the engine load can be reduced relative to that of the second mode in which the bleed-off flow rate is not actively controlled by the bleed-off flow control valve 8. In addition, while the pump flow rate decreases in the first mode, the bleed-off flow rate also becomes small. As shown in FIG. 5(*f*), since the meter-in flow rate does not experience significant changes in behavior, compared to that of the second mode, an actuator speed and operability that are equivalent to those achievable in the second mode can be ensured.

As described above, in the present embodiment, the meter-in flow rate is not reduced to zero and the bleed-off flow rate is controlled to ensure an appropriate meter-in flow rate. That is to say, the hydraulic fluid of a reasonable flow rate is supplied to the tank 6 via the bleed-off flow control valve 8, and at the same time, the pump flow rate is lowered for a particular reduction in bleed-off flow rate. Thus even during heavy-load work, the hydraulic fluid delivered from the hydraulic pump 2 can be prevented from being lost in the way and causing the fluid delivery pressure of the pump to rise to a level higher than necessary and reach a relief pressure level. Accordingly an actuator speed matching the amount of manipulation of the lever can be achieved. In the present embodiment, therefore, energy saving can be realized while inhibiting the occurrence of a sense of strangeness or discomfort in the operation.

Additionally, in the present embodiment, although the operation mode changes from the first mode to the second mode automatically in case of a failure in the pressure sensor 9, the pump control pressure generator 10, the bleed-off control pressure generator 11, or the like, this mode shift does not change a manipulation feeling since the actuator speed and operability that are equivalent to those achievable in the second mode can be ensured in the first mode. From a different perspective, there is an advantage that even if continuing machine operation in the first mode for a reason such as an abnormality of the pressure sensor 9 or the like turns out to cause a situation where a sense of strangeness or discomfort in the operation can occur, the first mode changes to the second mode automatically and operation can be continued properly even under the abnormal state of the pressure sensor 9 or the like.

Second Embodiment

Figure 6:
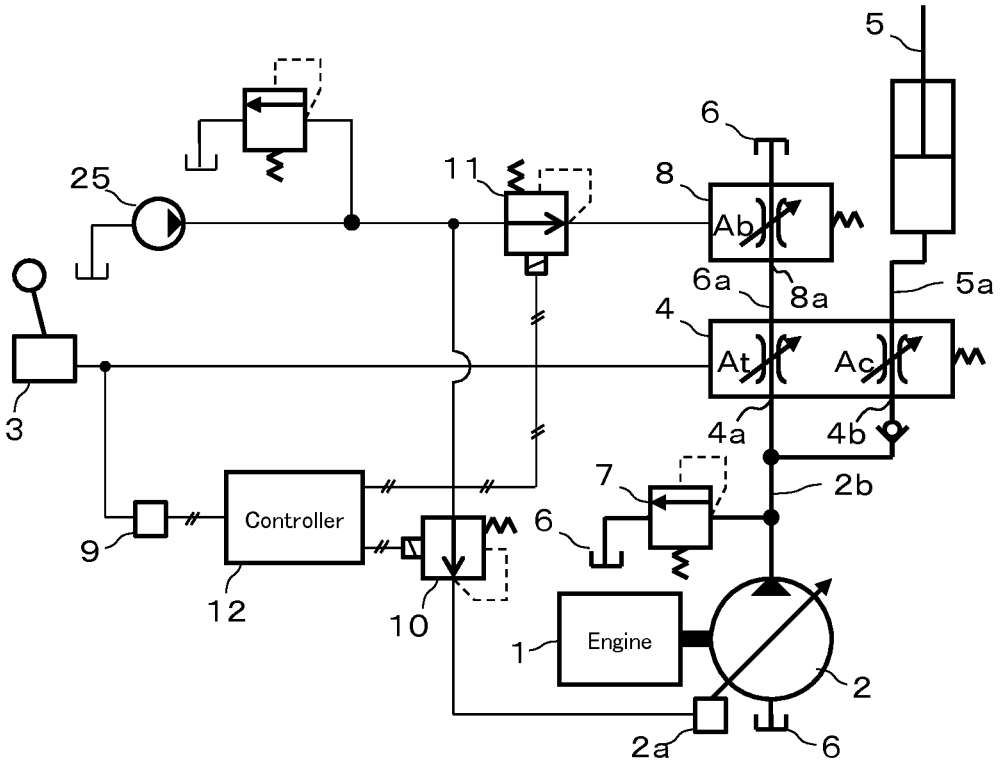
FIG. 6 is a circuit diagram that represents chief elements of a hydraulic drive system in a selectively extracted form, the system being provided on a work machine according to a second embodiment of the present invention.

FIG. 6 is a circuit diagram that represents chief elements of a hydraulic drive system in a selectively extracted form, the system being provided on a work machine according to a second embodiment of the present invention, FIG. 6 corresponding to FIG. 2 in the first embodiment. In FIG. 6, therefore, the elements already described in the first embodiment are each assigned the same reference number as used in FIGS. 1 to 5, and description of these elements is omitted.

The present embodiment differs from the first embodiment in that a pilot pressure a pilot pump 25 has generated is a main pressure of the pump control pressure. More specifically in the present embodiment, a pump control pressure generator 10 generates the pump control pressure by reducing the pilot pressure from the pilot pump 25, and outputs the pump control pressure to a capacity control system 2*a* of the hydraulic pump 2. Other factors and elements whose description has been omitted are substantially the same as those of the first embodiment.

The present embodiment yields substantially the same advantageous effects as achievable in the first embodiment. In addition, the present embodiment, unlike the first embodiment, enables the pump control pressure to be higher than the operating pilot pressure. This further allows the present embodiment to be applied more suitably to the use of larger hydraulic pumps and actuators.

Third Embodiment

Figure 7:
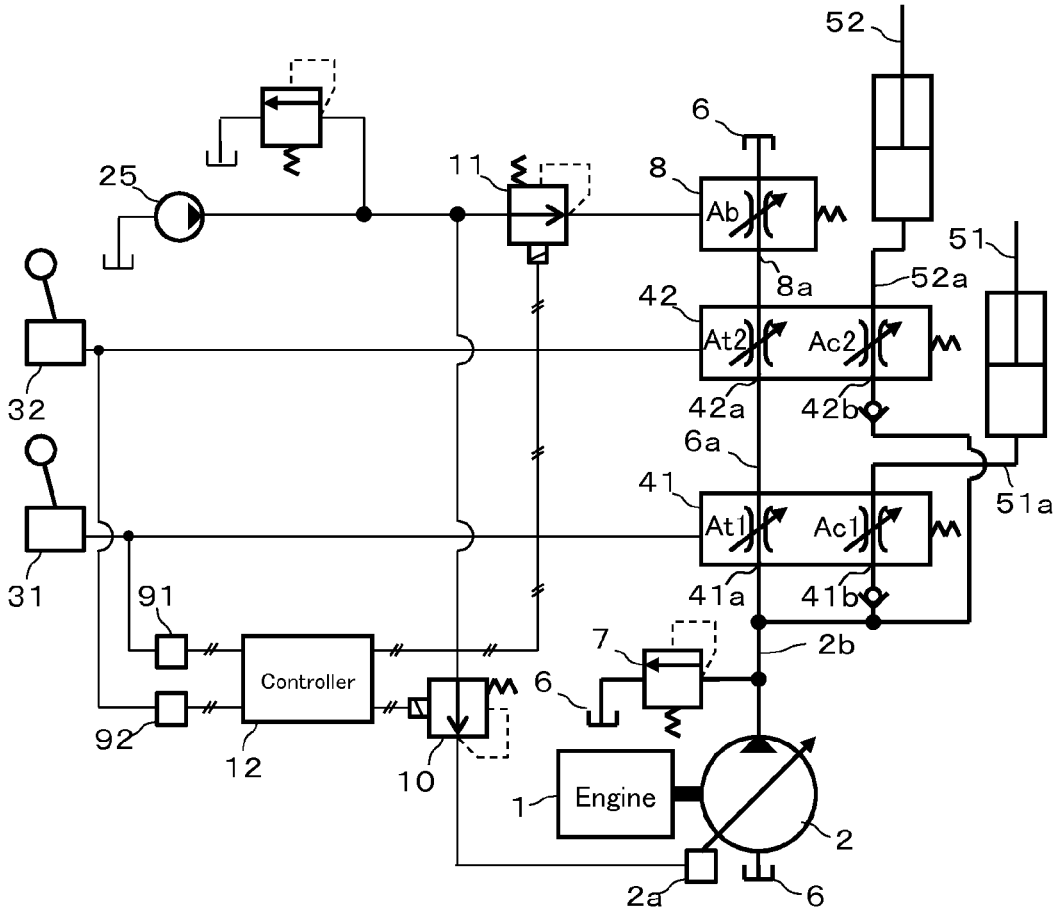
FIG. 7 is a circuit diagram that represents chief elements of a hydraulic drive system in a selectively extracted form, the system being provided on a work machine according to a third embodiment of the present invention.
Figure 8:
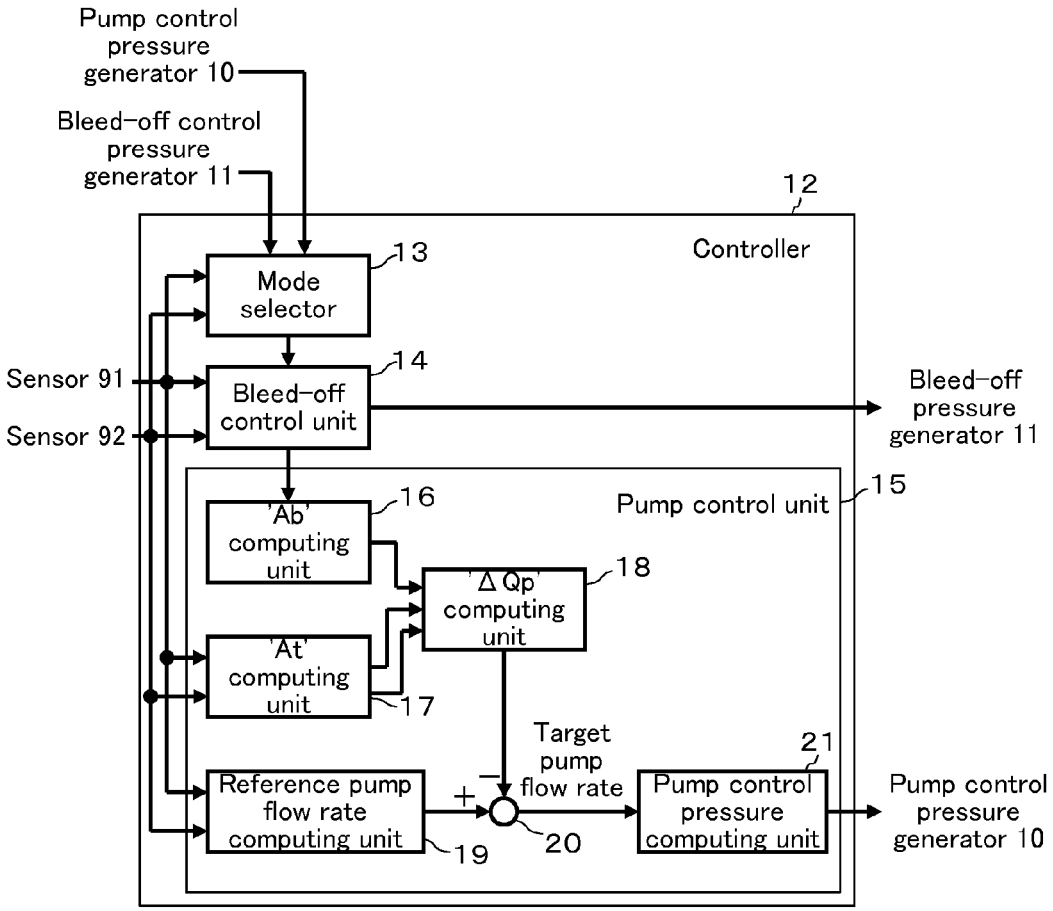
FIG. 8 is a function block diagram of a controller provided on the work machine according to the third embodiment of the present invention.

FIG. 7 is a circuit diagram that represents chief elements of a hydraulic drive system in a selectively extracted form, the system being provided on a work machine according to a third embodiment of the present invention. FIG. 8 is a function block diagram of a controller provided on the work machine in accordance with the third embodiment of the present invention. FIG. 7 corresponds to FIGS. 2 and 6, and FIG. 8 corresponds FIG. 3. In FIGS. 7 and 8, therefore, the elements already described in the first and second embodiments are each assigned the same reference number as used in FIGS. 1 to 6, and thus description of these elements is omitted.

The present embodiment differs from the first and second embodiments in that a plurality of hydraulic actuators (in the present embodiment, two actuators, 51 and 52) are driven by a hydraulic fluid delivered from the same hydraulic pump 2. Flow rates of the hydraulic fluid supplied to the hydraulic actuators 51 and 52 via meter-in fluid lines 51*a* and 52*a*, respectively, are controlled by actuator flow control valves 41 and 42; spool positions of the actuator flow control valves 41 and 42 are controlled by operating pilot pressures generated by lever control devices 31 and 32, respectively. In addition, electrical signals based on the operating pilot pressures generated by the lever control devices 31 and 32 are output from pressure sensors 91 and 92 to a controller 12. Bleed-off openings 41*a* and 42*a* in the actuator flow control valves 41 and 42 are arranged in series on the bleed-off line 6*a*, while the hydraulic fluid that has been delivered from the hydraulic pump 2 can flow into the tank 6 through the actuator flow control valves 41 and 42 and the bleed-off openings 41*a*, 42*a*, and 8*a* of a bleed-off flow control valve 8. Although other circuit elements are substantially the same as those of the second embodiment, the main pressure of the pump control pressure can be the operating pilot pressures generated by the lever control devices 31 and 32 as in the first embodiment.

Furthermore, the signals from the pressure sensors 91 and 92 are input to the mode selector 13, bleed-off control unit 14, 'At' computing unit 17, and reference pump flow rate computing unit 19 of the controller 12, wherein a mode determination and various computations are conducted in accordance with the signals from the pressure sensors 91 and 92.

Let areas of a meter-in opening 41*b* and bleed-off opening 41*a* in the actuator flow control valve 41 be defined as Ac1 and At1, respectively, areas of a meter-in opening 42*b* and bleed-off opening 42*a* in the actuator flow control valve 42 as Ac2 and At2, respectively, the opening area of the bleed-off flow control valve 8 as Ab, the fluid delivery pressure of the hydraulic pump 2 as Pp, a meter-in pressure of the hydraulic actuator 51 as Pc1, a meter-in pressure of the hydraulic actuator 52 as Pc2, and the internal pressure of the tank 6 as Pt. The pump flow rate Qp, a meter-in flow rate Qc1 of the hydraulic actuator 51, a meter-in flow rate Qc2 of the hydraulic actuator 52, and the bleed-off flow Qt can then be expressed as follows:

$$Qp=Qc1+Qc2+Qt \quad \text{(Formula 8)}$$

$$Qc1=c\cdot Ac1\cdot(Pp-Pc1)^{1/2} \quad \text{(Formula 9)}$$

$$Qc2=c\cdot Ac2\cdot(Pp-Pc2)^{1/2} \quad \text{(Formula 10)}$$

$$Qt=c\cdot\Delta At''\cdot(Pp-Pt)^{1/2} \quad \text{(Formula 11)}$$

where At", denoting a combined opening area of At1, At2, and Ab, can be calculated as follows:

$$\Delta At''=(At1\cdot At2\cdot Ab)/\{(At1\cdot At2)^2+(At1\cdot Ab)^2+(At2\cdot Ab)^2\}^{1/2} \quad \text{(Formula 12)}$$

The mode selector 13 selects the first mode when the pressure sensors 91 and 92, the bleed-off control pressure generator 11, and the pump control pressure generator 10 are all in a normal operation, or selects the second mode if any one of these elements is in an abnormal operation, and then outputs either selection result to the bleed-off control unit 14.

The bleed-off control unit 14 determines a command value of a bleed-off control pressure on the basis of the signal from the pressure sensor 91 or 92 (i.e., the operating pilot pressure of the lever control device 31 or 32). For example, if such an independent table as in FIG. 4(*a*) is set in advance for each of the operating pilot pressures of the lever control devices 31 and 32, the bleed-off control unit 14 computes bleed-off control pressures for the signals input from the pressure sensors 91 and 92, then after selecting the larger of the two computed values in this example, outputs the selected value as the command value of the bleed-off control pressure to the bleed-off control pressure generator 11.

The 'At' computing unit 17 estimates the bleed-off opening area At1 or At2 of the actuator flow control valve 41 or 42, respectively, that is based on the signal from the pressure sensor 91 or 92. For example, if such an independent table as in FIG. 4(*c*) is set in advance for each of the operating pilot pressures of the lever control devices 31 and 32, the 'At' computing unit 17 computes the bleed-off opening area At1 or At2 based on the signal input from the pressure sensor 91 or 92.

The 'ΔQp' computing unit 18 computes a decrement in bleed-off flow Qt due to a decrease in the degree of opening of the bleed-off flow control valve 8, and outputs the computed value as a target decrement ΔQp in pump flow rate. For example, ΔQp is calculated using the following formula:

$$\Delta Qp=c\cdot\Delta At''\cdot(Pp-Pt)^{1/2} \quad \text{(Formula 13)}$$

where ΔAt" is a decrement in the combined opening area of Ab, At1, and At2. If the maximum value of the opening area Ab is defined as Abmax, ΔAt" can be represented using the following formula:

$$\Delta At''=(At1\cdot At2\cdot Ab\max)/\{(At1\cdot At2)^2+(At1\cdot Ab\max)^2+(At2\cdot Ab\max)^2\}^{1/2}-(At1\cdot At2\cdot Ab)/\{(At1\cdot At2)^2+(At1\cdot Ab)^2+(At2\cdot Ab)^2\}^{1/2} \quad \text{(Formula 14)}$$

On the basis of the signal from the pressure sensor 91 or 92, the reference pump flow rate computing unit 19 computes the pump flow rate in the second mode, and outputs the computed value as a reference pump flow rate. For this purpose, an independent table of reference pump flow rates is set in advance for each of the operating pilot pressures of the lever control devices 31 and 32. The reference pump flow rate computing unit 19 computes the pump flow rates based on the signals input from the pressure sensors 91 and 92, and outputs the larger of the two computed values as the reference pump flow rate.

Other elements, namely the 'Ab' computing unit 16, the differential computing unit 20, and the pump control pressure computing unit 21, execute substantially the same processes as in the first and second embodiments. The result is that in the first mode, the degree of opening of the bleed-off flow control valve 8 is controlled in accordance with the particular amount of manipulation. In addition, the pump flow rate is corrected and controlled in accordance with the degree of opening of the bleed-off flow control valve 8. In the second mode, the degree of opening of the bleed-off flow control valve 8 is not controlled (remains set to the maximum degree of opening) and thus ΔQp equals to 0, so that the pump flow rate is controlled to obtain a target flow rate as a reference pump flow rate based on the amount of manipulation.

As in the third embodiment, the present invention can also be applied to driving the hydraulic actuators 51 and 52 by use of the hydraulic fluid delivered from the same hydraulic pump 2, and the invention yields substantially the same advantageous effects as those obtainable in the first embodiment.

Fourth Embodiment

Figure 9:
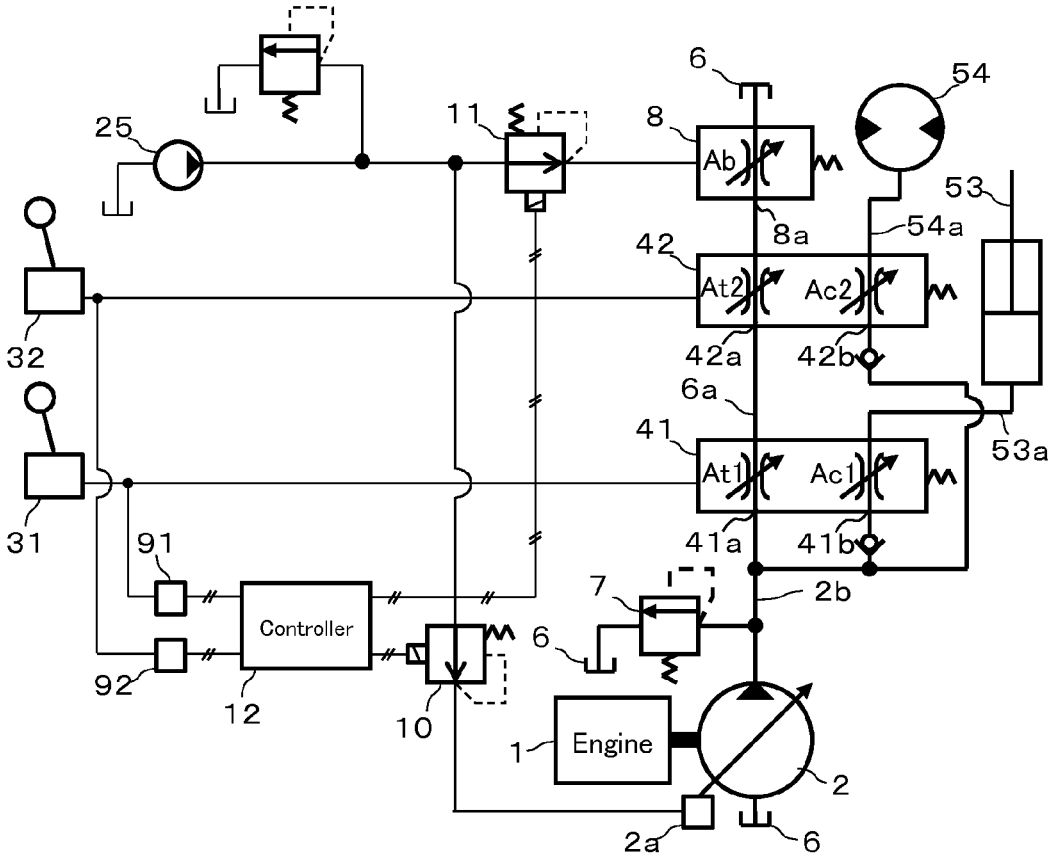
FIG. 9 is a circuit diagram that represents chief elements of a hydraulic drive system in a selectively extracted form, the system being provided on a work machine according to a fourth embodiment of the present invention.

FIG. 9 is a circuit diagram that represents chief elements of a hydraulic drive system in a selectively extracted form, the system being provided on a work machine according to the fourth embodiment of the present invention and the circuit elements in FIG. 9 being substantially the same as those shown in FIGS. 2, 6, and 7. In FIG. 9, therefore, the elements already described in the first to third embodiments are each assigned the same reference number as used in FIGS. 1 to 8, and thus description of these elements is omitted.

The present embodiment is substantially the same as the third embodiment in that a plurality of hydraulic actuators are driven by a hydraulic fluid delivered from the same hydraulic pump 2. A configuration in which a hydraulic actuator 53 serving as a hydraulic cylinder, and a hydraulic actuator 54 serving as a hydraulic motor are driven by the hydraulic fluid delivered from the hydraulic pump 2 is shown and described specifically as an example in the present embodiment. The hydraulic actuator 53 is a hydraulic cylinder that drives a work tool 106, the hydraulic cylinder being either the boom cylinder 111, arm cylinder 113, or bucket cylinder shown in FIG. 1. The hydraulic actuator 54 is either a swing motor that swingably drives, for example, the swing structure 102 shown in FIG. 1, or a track motor that drives, for example, the track structure 101 shown in FIG. 1 and causes the hydraulic excavator 100 to travel. In the circuit diagram of FIG. 9, a flow of the hydraulic fluid into the hydraulic actuators 53 and 54 is controlled by the actuator flow control valves 41 and 42. While other circuit elements are substantially the same as those of the third embodiment, the main pressure of the pump control pressure can be used as the operating pilot pressure generated by at least one of the lever control devices 31 and 32 as in the first embodiment.

In the present embodiment, it goes without saying that substantially the same advantageous effects as in the other embodiments can be obtained by selecting a mode, depending on whether the pressure sensor 91 or 92 or the like is abnormal. However, in circuit composition with the bleed-off openings 41*a* and 42*a* of the actuator flow control valves 41 and 42 connected in series as in the present embodiment, if the bleed-off opening area of one actuator flow control valve decreases at a high rate during the simultaneous driving of the hydraulic actuators 53 and 54, the flow rate of the fluid through the bleed-off opening in the other actuator flow control valve is likely to be limited irrespective of the spool position in the one actuator flow control valve.

In the present embodiment, in particular, the bleed-off openings 41*a* and 42*a* of the actuator flow control valves 41 and 42 in the swing motor or track motor sections are connected in series. For example, when the swing or track operation is specified, if the bleed-off flow rate of the hydraulic fluid supplied from the hydraulic pump 2 to the tank 6 approaches 0, much of the hydraulic fluid delivered from the hydraulic pump 2 will attempt to flow into the hydraulic actuator 54. Large inertia of the swing structure 102 and vehicle body (hydraulic excavator 100), however, will require a great amount of time for both to increase their speed to a value matching the amount of manipulation. During this time the direction where the hydraulic fluid delivered from the hydraulic pump 2 flows will be limited and the fluid delivery pressure of the hydraulic pump 2 will rise. For this reason, even if the amount of manipulation is extremely small, the fluid delivery pressure of the hydraulic pump 2 may temporarily increase to the relief pressure or to a value close thereto. The operation of the swing structure 102 or track structure 101 may increase its acceleration to a level higher than that actually needed as well. A sense of strangeness or discomfort in the operation could arise consequently.

In the present embodiment, therefore, even when the pressure sensors 91 and 92, the pump control pressure generator 10, and the bleed-off control pressure generator 11 are all in a normal operation, the mode selector 13 will select the first mode only if the operation of the hydraulic actuator 53 other than the swing motor and the like is specified alone (i.e., if a lever control device 31 only is manipulated). Alternatively, the mode selector 13 will select the second mode if the operation of the hydraulic actuator 54 which is the swing motor or the like is specified (i.e., if a lever control device 32 is manipulated). In the latter case, the specification of operation includes that of both hydraulic actuators 53 and (i.e., simultaneous manipulation of the lever control devices 31 and 32). However, if the operation of at least one of the pressure sensors 91 and 92, the pump control pressure generator 10, and the bleed-off control pressure generator 11 is determined to be abnormal, then as in the previous embodiments of the present invention, a change to the second mode will take place regardless of the operation of which of the two hydraulic actuators, that is, 53 or 54, is specified by the operating pilot pressure that has been input to the controller 12.

In accordance with the present embodiment, narrowing down the bleed-off flow rate to a level lower than that actually needed during swing or track operation can be avoided, which will in turn lead to preventing the acceleration of the swing or track operation from being influenced by the spool position of the actuator flow control valve 41 and from increasing to a value greater than that actually needed. When the hydraulic fluid is supplied only to the hydraulic actuator 53 without the swing or track operation being involved, however, the present embodiment provides substantially the same advantageous effects as those obtainable in the other embodiments of the present invention.

In the present embodiment, even if the pressure sensor 91 or 92 or the like is not in an abnormal state, when the operation of the hydraulic actuator 54 serving as the swing motor or the like is specified, the second mode is selected irrespective of whether the operation of the other hydraulic actuator 53 is specified. Unless the pressure sensor 91 or 92 or the like is in an abnormal state, however, the second mode may be selected when the operation of both of the hydraulic actuators 53 and 54 is specified. In other words, the present embodiment may adopt other circuit composition, where the mode selector 13 allows the first mode to be selected when the operating pilot pressure that was input to the controller 12 specifies the operation of one of the two hydraulic actuators, namely 53 or 54, or the second mode to be selected when the operating pilot pressure specifies the operation of the hydraulic actuators 53 and 54 simultaneously. In addition, the mode selector 13 subsequently outputs either selection result to the bleed-off control unit 14.

OTHERS

While an example of controlling the pump flow rate by virtue of tilt control of the hydraulic pump 2 has been described in each of the above embodiments, the pump flow rate may be controlled by, for example, controlling the pump speed. The hydraulic pump in this case can be of a fixed capacity.

In addition, if the bleed-off control pressure is not generated, the degree of opening of the bleed-off flow control valve 8 will not be controlled. Instead, the degree of opening remains fixed at its maximum level. This being the case, in the second mode, since the degree of opening of the bleed-off flow control valve 8 remains maximized, the bleed-off flow rate does not decrease relative to that obtained when the same operation is performed in the first mode of controlling the degree of opening of the bleed-off flow control valve 8. Provided that the same operation is performed, the pump flow rate in the second mode will not be lower than that of the first mode. However, the degree of opening of the bleed-off flow control valve 8 could remain fixed at a minimum level or an intermediate level if the bleed-off control pressure is not generated. This being the case, since the pump flow rate in the second mode can be lower than that obtainable when the same operation is performed in the first mode, the pump flow rate in the second mode during the same operation could be lower than that obtainable in the first mode.

Furthermore, while the lever control devices 3, 31, and 32 have been described as examples of operating devices, these operating devices can also include other forms of elements, such as pedals.

DESCRIPTION OF REFERENCE NUMBERS

2: Hydraulic pump (Pump)
3, 31, 32: Lever control devices (Operating devices)
4, 41, 42: Actuator flow control valves
5, 51, 52: Hydraulic actuators (Actuators)
6: Tank
8: Bleed-off flow control valve
8*a*: Bleed-off fluid line
13: Mode selector
14: Bleed-off control unit (Bleed-off control device)
15: Pump control unit (Pump control device)
53: Hydraulic actuator (Actuator or second actuator)
54: Hydraulic actuator (Actuator or first actuator)
100: Hydraulic excavator (Work machine)
101: Track structure
102: Swing structure

The invention claimed is:

1. A work machine comprising:

a variable-displacement pump;

at least one actuator driven by a hydraulic fluid delivered from the pump;

a flow control valve of an open-center type that controls a flow rate of the hydraulic fluid supplied to the actuator;

a bleed-off line connecting the actuator flow control valve to a tank;

a bleed-off flow control valve disposed in the bleed-off line;

a lever device adapted to specify operation of the actuator;

a bleed-off control device adapted to selectively execute one of a first mode and a second mode, the first mode being for controlling a degree of opening of the bleed-off flow control valve in accordance with an amount of manipulation of the lever device, the second mode being for controlling the degree of opening of the bleed-off flow control valve to a fixed degree of opening independently of the amount of manipulation of the lever device; and a pump control device adapted to control, in accordance with the degree of opening of the bleed-off flow control valve, a pump flow rate by correcting a reference pump flow rate that is based on the amount of manipulation of the lever device, wherein the pump control device reduces the pump flow rate, with respect to the reference pump flow rate that is based on the amount of manipulation of the lever device, as the degree of opening of the bleed-off flow control valve becomes smaller.

2. The work machine according to claim 1, wherein in the second mode, the bleed-off control device maximizes the degree of opening of the bleed-off flow control valve.

3. The work machine according to claim 1, further comprising:

a mode selector that selects the first mode when control operation of both the pump and the bleed-off flow control valve is normal, or selects the second mode when the control operation of at least one of the pump and the bleed-off flow control valve is abnormal, and then outputs either selection result to the bleed-off control device.

4. The work machine according to claim 1, wherein the at least one actuator includes a first actuator and a second actuator, the first actuator driving a track structure or a swing structure swingably provided on the track structure, the second actuator driving a work tool provided on the swing structure; and wherein bleed-off openings of two actuator flow control valves that control a flow rate of the hydraulic fluid used in the first actuator and the second actuator, the bleed-off openings are connected in series to each other;

the work machine including a mode selector that selects the first mode when a signal from the lever device specifies operation of the second actuator only, or selects the second mode when the signal from the lever device specifies operation of the first actuator, and then outputs either selection result to the bleed-off control device.

5. The work machine according to claim 1, wherein the at least one actuator includes a first actuator and a second actuator, the first actuator driving a track structure or a swing structure swingably provided on the track structure, the second actuator driving a work tool provided on the swing structure;

wherein bleed-off openings of two actuator flow control valves that control a flow rate of the hydraulic fluid used in the first actuator and the second actuator, the bleed-off openings are connected in series to each other;

the work machine including a mode selector that selects the first mode when a signal from the lever device specifies operation of one of the first actuator and the second actuator, or selects the second mode when the signal from the lever device simultaneously specifies operation of both the first actuator and the second actuator, and then outputs either selection result to the bleed-off control device.

* * * * *